US009809344B2

(12) United States Patent
Kress

(10) Patent No.: US 9,809,344 B2
(45) Date of Patent: Nov. 7, 2017

(54) LABELLING UNIT, DEVICE AND METHOD FOR LABELLING CONTAINERS

(71) Applicant: KHS GmbH, Dortmund (DE)

(72) Inventor: Oliver Kress, Waltrop (DE)

(73) Assignee: KHS GmbH, Dortmund (DE)

( * ) Notice: Subject to any disclaimer, the term of this patent is extended or adjusted under 35 U.S.C. 154(b) by 674 days.

(21) Appl. No.: 14/369,835

(22) PCT Filed: Nov. 30, 2012

(86) PCT No.: PCT/EP2012/004947
§ 371 (c)(1),
(2) Date: Jun. 30, 2014

(87) PCT Pub. No.: WO2013/113346
PCT Pub. Date: Aug. 8, 2013

(65) Prior Publication Data

US 2014/0367038 A1 Dec. 18, 2014

(30) Foreign Application Priority Data

Jan. 31, 2012 (DE) ..... 10 2012 001 723

(51) Int. Cl.
*B65C 9/08* (2006.01)
*B65C 9/18* (2006.01)
*B65C 9/00* (2006.01)

(52) U.S. Cl.
CPC ..... *B65C 9/08* (2013.01); *B65C 9/0006* (2013.01); *B65C 9/1819* (2013.01); *B65C 2009/0071* (2013.01)

(58) Field of Classification Search
CPC ..... B65C 9/14; B65C 9/08; B65C 9/1819
USPC ..... 156/363, 364, 566, 568, 552
See application file for complete search history.

(56) References Cited

U.S. PATENT DOCUMENTS

| | | | | |
|---|---|---|---|---|
| 3,404,059 | A * | 10/1968 | Ritterhoff | B65C 3/12 156/363 |
| 3,634,175 | A | 1/1972 | Vite et al. | |
| 5,538,575 | A | 7/1996 | Hinton | |
| 2007/0039684 | A1* | 2/2007 | Nedblake | B65C 9/0006 156/249 |
| 2007/0240828 | A1 | 10/2007 | Ito et al. | |

FOREIGN PATENT DOCUMENTS

| | | |
|---|---|---|
| DE | 8900323 | 3/1990 |
| DE | 9016591 | 2/1991 |
| DE | 4027247 | 8/1991 |
| DE | 10305315 | 9/2003 |
| DE | 10230336 | 1/2004 |

(Continued)

*Primary Examiner* — Jeff Aftergut
*Assistant Examiner* — Jaeyun Lee
(74) *Attorney, Agent, or Firm* — Occhiuti & Rohlicek LLP

(57) ABSTRACT

A labeling unit for applying labels to containers includes a label removing device, a vacuum drum, and a gluing device. The vacuum drum receives labels at a first transfer position and delivers them to a second transfer position. The gluing device is arranged within an angular region of rotary motion of the vacuum drum between the first and second transfer positions. The vacuum drum moves labels past the gluing device. The label removal device removes either labels or label residues that remain on the vacuum drum in the angular region.

18 Claims, 4 Drawing Sheets

(56) References Cited

FOREIGN PATENT DOCUMENTS

| | | |
|---|---|---|
| ES | 267219 | 3/1983 |
| FR | 1346456 | 12/1963 |
| JP | 6099961 | 4/1994 |
| JP | 5090030 | 10/2008 |
| JP | 5147636 | 4/2010 |
| WO | WO2010/072654 | 7/2010 |

* cited by examiner

LABELLING UNIT, DEVICE AND METHOD FOR LABELLING CONTAINERS

RELATED APPLICATIONS

This application is the national stage entry of PCT/EP2012/004947, filed on Nov. 30, 2012, which claims the benefit of the Jan. 31, 2012 priority date of German application DE 10 2012 001 723.5 the content of which is herein incorporated by reference.

FIELD OF INVENTION

The invention relates to container processing, and in particular, to labeling containers.

BACKGROUND

Labeling machines that glue labels to containers are known. These labels are transferred to containers by a vacuum drum.

In some cases, a glued label is not properly removed from the vacuum drum or is not transferred to a container. Instead, it is left on the vacuum drum. This label can eventually become detached from the vacuum drum, possibly leading to uncontrolled fouling or to uncontrolled disturbances in downstream labeling operations.

A label can fail to be detached for many reasons. One reason is a malfunction of the labeling unit itself. But the most common reason is that there is no container present at the time the label presents itself for transfer. This occurs, for example, when there is a gap in the container stream.

A known solution was to provide a buffer or storage table in the container transport direction upstream of each labeling machine and to accumulate a supply of containers awaiting labeling during operation. This supply enabled the labeling machine to be continuously operated. The operating speed or throughput of the labeling machine was increased or decreased as the supply of containers on the buffer or storage table rose or fell respectively so as to ensure the uninterrupted operation of the labeling machine and to avoid the presence of gaps appearing in the container stream being fed to the labeling machine.

By using a buffer or storage table and monitoring the supply of containers on that table it was also in particular possible to react to larger, longer-lasting gaps in the container stream being fed to the buffer and storage table by controlling the labeling unit accordingly. For example, a long gap in the container stream can be dealt with by moving the gluing device, which is provided within the labeling unit, away from its working position, which is very close to the vacuum drum, to an idle position, which is at a greater distance away from the vacuum drum. This shifting of the gluing device reliably prevents the vacuum drum and labeling unit from being fouled by glue and/or by labels that have been glued but not transferred to containers.

In modern container treatment installations, the component machines are increasingly interlocked with one another in such a way that the containers are conveyed with accurate spacing by transport star-wheels from one container treatment machine to a subsequent container treatment machine. This precludes the use of a buffer. As a result, the known method for compensating for gaps in the container stream is no longer effective. Consequently, different container treatment machines can no longer react individually to variations in the container stream by varying their operating speeds.

With labeling machines in particular, the problem arises that they should still react in an appropriate way to gaps in the container stream, i.e. to missing containers. Particularly with container treatment plants that have a high throughput (number of treated containers per unit of time), for example container treatment plants that process more than 40,000 containers per hour, the time between two containers is less than 0.09 seconds. Even if it were theoretically possible to suppress the presenting of a label for a "missing" container within a very short time interval, it is simply not possible, because of its relatively high mass, to control the gluing device at the vacuum drum so that if the label is "missing", no glue is applied to the vacuum drum and the vacuum drum is not fouled by glue as a result. For this reason it would be practicable, at least with brief interruptions in the container stream, to present labels even for containers that are not present at the vacuum drum so as to prevent glue being applied directly to the vacuum drum and fouling the vacuum drum, and even allowing for the risk of the labeling unit being fouled and further labeling operations being disrupted by labels not transferred to containers and falling from the vacuum drum.

SUMMARY

The object of the invention is to provide a labeling unit that offers a high level of reliability while avoiding the disadvantages of known labeling units and in particular that avoids an uncontrolled fouling of the labeling unit and hence uncontrollable disruptions due to labels not being properly removed from the vacuum drum and/or transferred to containers.

According to the inventive labeling unit, labels that are not properly removed from the vacuum drum at a transfer position, for example labels not transferred to a passing container after passing the transfer position, are removed from the vacuum drum by a label removal device, preferably by mechanical detachment or guided lift-off, so that these labels cannot disrupt the labeling operation and are instead transferred to a label receptacle or corresponding container.

According to a preferred embodiment of the invention, the label removal device is configured so that it also assists transmission of the labels at the transfer position, for example to containers passing that point.

In one embodiment, the label removal device comprises at least one belt-shaped element that forms a closed loop, part of whose length, i.e. a first loop length, surrounds the vacuum drum over part of its circumference, preferably at least over an angular region between a first transfer position, where the labels are transferred to the vacuum drum, and a second transfer position where the labels are removed from the vacuum drum in normal undisrupted labeling mode and for example passed or transferred to the containers. For a part-length that follows the second transfer position in the direction of rotation of the vacuum drum, the at least one belt-shaped element runs at a distance away from the vacuum drum.

The at least one belt-shaped element and/or its loop are driven to circulate, preferably in the same direction as the vacuum drum, by, for example, the vacuum drum, e.g. through frictional contact, or by having its own dedicated drive.

There are provided, preferably, at least two or more than two belt-shaped elements, each forming a closed loop, they or their loop levels being offset relative to and spaced apart from one another in the direction of an axis of rotation of the vacuum drum.

The inventive configuration enables the labeling unit to continue to be operated in case of interruptions, particularly in case of brief interruptions, in the container flow, and without the risk of the vacuum drum being fouled by glue application or the labeling unit being fouled by labels that although, glued, were not properly transferred from the vacuum drum to the containers.

For the purpose of the invention the expression "substantially" means variations from the respective exact value by +/−10%, preferably by +/−5% and/or variations in the form of changes insignificant for the function.

In one aspect, the invention features a labeling unit for applying labels to containers. Such a labeling unit includes a label removing device, a vacuum drum, and a gluing device. The vacuum drum rotates along a first rotation direction about a drum axis. As it does so, it receives labels at a first transfer position and delivers them to a second transfer position. The gluing device is arranged within an angular region of rotary motion of the vacuum drum that extends between the first and second transfer positions. The vacuum drum is configured to move labels past the gluing device. The gluing device is configured to glue passing labels using the vacuum drum. The label removal device is configured for removing at least one of labels and label residues that remain on the vacuum drum in the angular region.

Some embodiments further include a belt-shaped element forming a closed loop and surrounding the vacuum drum with a first loop length over an angular region of rotary motion of the vacuum drum at least between the first transfer position and the second transfer position and forming at least a second loop length that follows the second transfer position and on which the belt-shaped element is spaced at a distance from a periphery of the vacuum drum. Among these embodiments are those in which the label removal device comprises two belt-shaped elements, each of which forms a closed loop, the loops being offset relative to and spaced apart from one another in a direction along the drum axis, those in which the belt-shaped element is driven to rotate along the first rotation direction, those in which the belt-shaped element is driven to rotate by friction, and those in which the belt-shaped element is driven to rotate by the vacuum drum.

Some embodiments also include a separate drive. In these embodiments, the belt-shaped element is driven to rotate by the separate drive.

In yet other embodiments, the labeling unit is configured for relative motion between the vacuum drum and the belt-shaped element.

Some embodiments further include a tensioning device. In these embodiments, the belt-shaped element is guided at the second loop length thereof over the tensioning device. Among these are embodiments in which the belt-shaped element is guided such that a maximum distance of the second loop length from at least one of the vacuum drum and a periphery of the vacuum drum is at least equal to 25% of the drum's diameter, or at least equal to between 30% and 200% of the diameter.

Other embodiments include a deflection. In these embodiments, the belt-shaped element is guided at the second loop length thereof over the deflection. Among these are embodiments in which the belt-shaped element is guided such that a maximum distance of the second loop length from at least one of the vacuum drum and a periphery of the vacuum drum is at least equal to 25% of the vacuum drum's diameter and embodiments in which the belt-shaped element is guided such that a maximum distance of the second loop length from at least one of the vacuum drum and a periphery of the vacuum drum is at least equal to between 30% and 200% of the vacuum drum's diameter.

There is also a grooved embodiment. This embodiment further comprises grooves in the vacuum drum. The grooves are disposed at least over a surface of the vacuum drum that forms a contact surface for labels. The grooves run in a peripheral direction of the vacuum drum. Each groove is configured to receive a belt-shaped element in a region of the first loop length. Each groove has a cross-section that is matched to a cross-section of the belt-shaped element such that the belt-shaped element is fully received in a groove. In some of these embodiments, there are vacuum openings offset from the grooves. The vacuum openings enable the labels to be held with a vacuum that is provided on the surfaces that form contact surfaces for the labels.

In some embodiments, the second transfer position is configured for a transfer of the labels to the containers.

Other embodiments include a transport element that can be driven to rotate. The transport element comprising a plurality of treatment positions, wherein the labeling unit is disposed in one of the treatment positions.

The invention also features a method for operating a labeling unit for applying labels to containers, the labeling unit comprising a label removing device, a vacuum drum, and a gluing device, wherein the vacuum drum is driven to rotate along a first rotation direction about a drum axis, wherein the vacuum drum receives labels at a first transfer position, wherein the vacuum drum delivers the labels to a second transfer position, wherein the gluing device is arranged within an angular region of rotary motion of the vacuum drum, wherein the angular region of rotary motion of the vacuum drum extends between the first transfer position and the second transfer position, wherein the vacuum drum is configured to move labels past the gluing device, wherein the gluing device is configured to glue labels that are moved past the gluing device by the vacuum drum, and wherein the label removal device is configured for removing at least one of labels and label residues that remain on the vacuum drum in the angular region. Such a method includes either receiving labels that have been left behind on the vacuum drum or removing labels that have been left behind on the vacuum drum.

Some practices include presenting and gluing labels when no bottles are present.

Other practices include receiving labels that have been left behind on the vacuum drum comprising receiving by at least one belt-shaped element that partially surrounds the vacuum drum with a first loop length that forms one part of a loop, and that is spaced apart from the vacuum drum with a second loop length that forms another part of the loop.

In another aspect, the invention features a labeling unit for applying labels to containers. Then unit includes a label removing device, a vacuum drum, and a gluing device. The vacuum drum receives labels at a first transfer position and delivers them to a second transfer position. The gluing device is arranged within an angular region of rotary motion of the vacuum drum between the first and second transfer positions. The vacuum drum moves labels past the gluing device. The label removal device removes either labels or label residues that remain on the vacuum drum in the angular region.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is explained in detail below through the use of embodiment examples with reference to the figures, in which.

DETAILED DESCRIPTION

Figure 1:
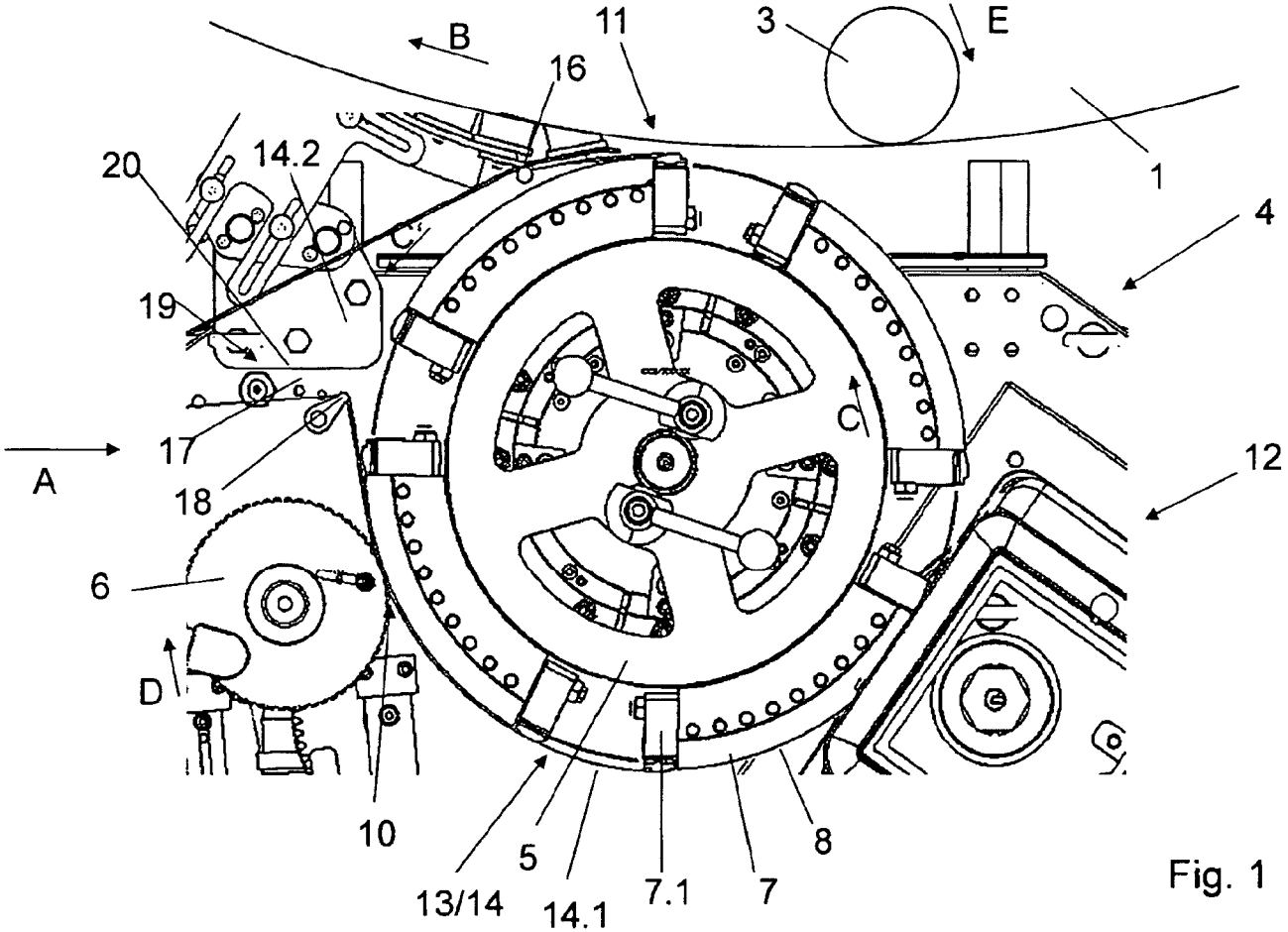
FIG. 1 is a simplified schematic partial view and plan view of a labeling unit according to the invention for labeling containers.

FIG. 1 shows a rotor 1 that can be driven to rotate about a vertical machine axis in the direction of arrow B, and that forms part of a labeling machine for applying labels 2 to containers 3, such as bottles.

For the purpose of labeling, containers 3 stand upright and disposed at treatment positions of the rotor 1. As used herein, a container is upright when its container axis is vertically oriented. The rotor 1 conveys the containers past a labeling unit 4, which does not rotate with rotor 1. Of the labeling unit 4, the figures show only a label transfer drum or vacuum drum 5 driven to rotate about a vertical axis synchronously with rotor 1 in the direction of arrow B, and the function elements of labeling unit 4 that directly interact with said drum.

The labeling unit 4 is configured, for example, for the processing of label strip material from which respective labels 2 are separated in a cutting device before being transferred to a vacuum drum 5 via a transport drum 6 that is also configured, for example, as a vacuum drum. The transport drum 6 is driven to rotate about a vertical axis synchronously with rotor 1 in the direction of arrow D. In one example, the transport drum 6 is part of the cutting device, the remainder of which is conventional and need not be shown. The transfer of labels 2 to the vacuum drum 5 is effected, for example, in such a way that each label 2 is held on the circumference of vacuum drum 5 with its first label short side 2.1 leading in the direction of rotation C of the vacuum drum 5, with its second label short side 2.2) trailing, and with its label long sides 2.3 oriented in direction of rotation C.

Figure 4:
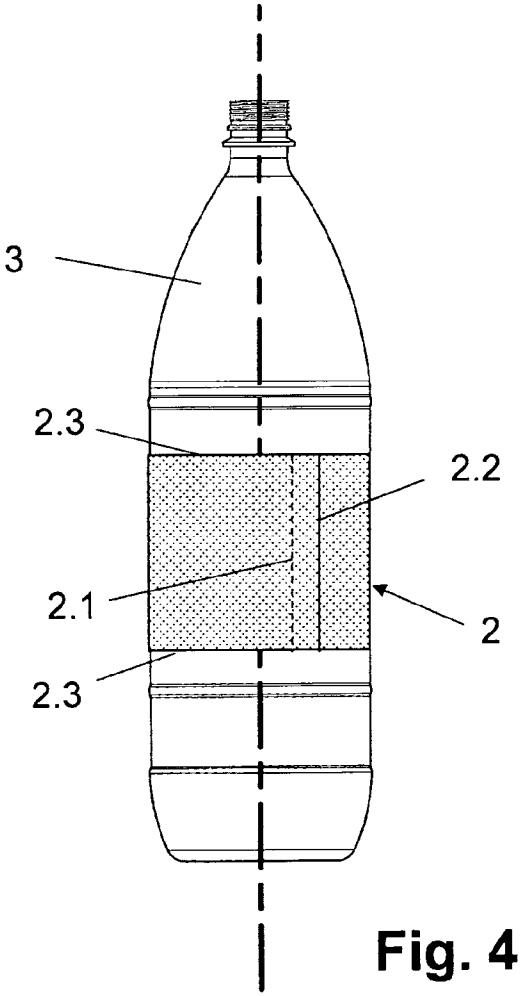
FIG. 4 shows, in side view, a container in the form of a bottle provided with a label.

The labeling unit 4 is also configured, for example, for an all-round labeling of containers 3. In this case a label 2 surrounds the container and its label short sides 2.1 and 2.2 overlap one another, as shown in FIG. 4.

The direction of rotation C of the vacuum drum 5 runs counter to the direction of rotation B of the rotor 1. The direction of rotation D of the transport drum 6 runs counter to the direction of rotation C of the vacuum drum 5.

The peripheral surface of the vacuum drum 5 is formed by, among other things, a plurality of segments 7 that succeed one another in the direction of rotation C and that are spaced apart from one another. Each segment 7 receives a label 2 and, using a vacuum, holds it in place with its front, which is visible after its application to container 3, in contact against an outer surface 8 of the segment 7. For this purpose, each outer surface 8, which is part of a circular-cylindrical surface, has a plurality of vacuum openings 9 to which a vacuum is applied in a controlled manner or at least over the angular region from the transfer of labels 2 to vacuum drum 5 at a first transfer position 10 until the transfer of labels 2 to containers 3 at a tangent point or second transfer position 11.

A gluing station 12 or gluing device is provided within the angular region of the rotary motion of the vacuum drum 5 between the first and second transfer positions 10 and 11. As the label 2 moves past it on the vacuum drum 5, the gluing device 12 applies glue to its back, at least in the region of its two label short sides 2.1 and 2.2.

At the second transfer position 11, each glued label 2 is then pressed, with its application of glue on the label short side 2.1, which is leading in direction of rotation C of the vacuum drum 5, onto the outer periphery of waiting container 3 where it is fully applied to the container 3 by rolling or wrapping. Rolling and wrapping takes place by rotating the container 3 about its vertical container axis in a direction indicated by the arrow E.

The containers 3 and the vacuum drum 5 rotate in opposite directions, as shown by the arrows C and E respectively.

There are times when labels 2 are not transferred to a container 3 and remain on vacuum drum 5. Such labels sometimes later fall unchecked from the vacuum drum 5. This can lead to stoppages arising from fouling of the vacuum drum and/or the labeling unit 4. A label-removal device 13 is provided to prevent this.

In the depicted embodiment, label removal device 13 comprises multiple belt-shaped elements 14. Each belt-shaped element 14 forms a closed loop that circulates in the same direction as vacuum drum 5. In the illustrated embodiment, there are four such belt-shaped elements 14 each of which has a loop level SE1-SE4 that is oriented at right angles to the axis of rotation of the vacuum drum 5. The loop levels SE1-SE4 are offset relative to and spaced apart from one another in the direction of the axis of rotation of the vacuum drum 5.

Each belt-shaped element 14 is guided over an angular region of the peripheral surface of the vacuum drum 5. This angular region is somewhat greater than the angular region of the rotary motion of the vacuum drum 5 between the first and second transfer positions 10 and 11. As a result, before the first transfer position 10, each belt-shaped element 14 already lies with a loop length 14.1 in contact against the periphery of vacuum drum 5, and at the second transfer position 11 or immediately thereafter, each belt-shaped element 14 is guided by its loop length 14.2 outward away from the periphery of vacuum drum 5, in each case relative to the direction of rotation of vacuum drum 5 (arrow C) or the direction of circulation, as indicated by the arrow C, of the belt-shaped elements 14.

Figure 2:
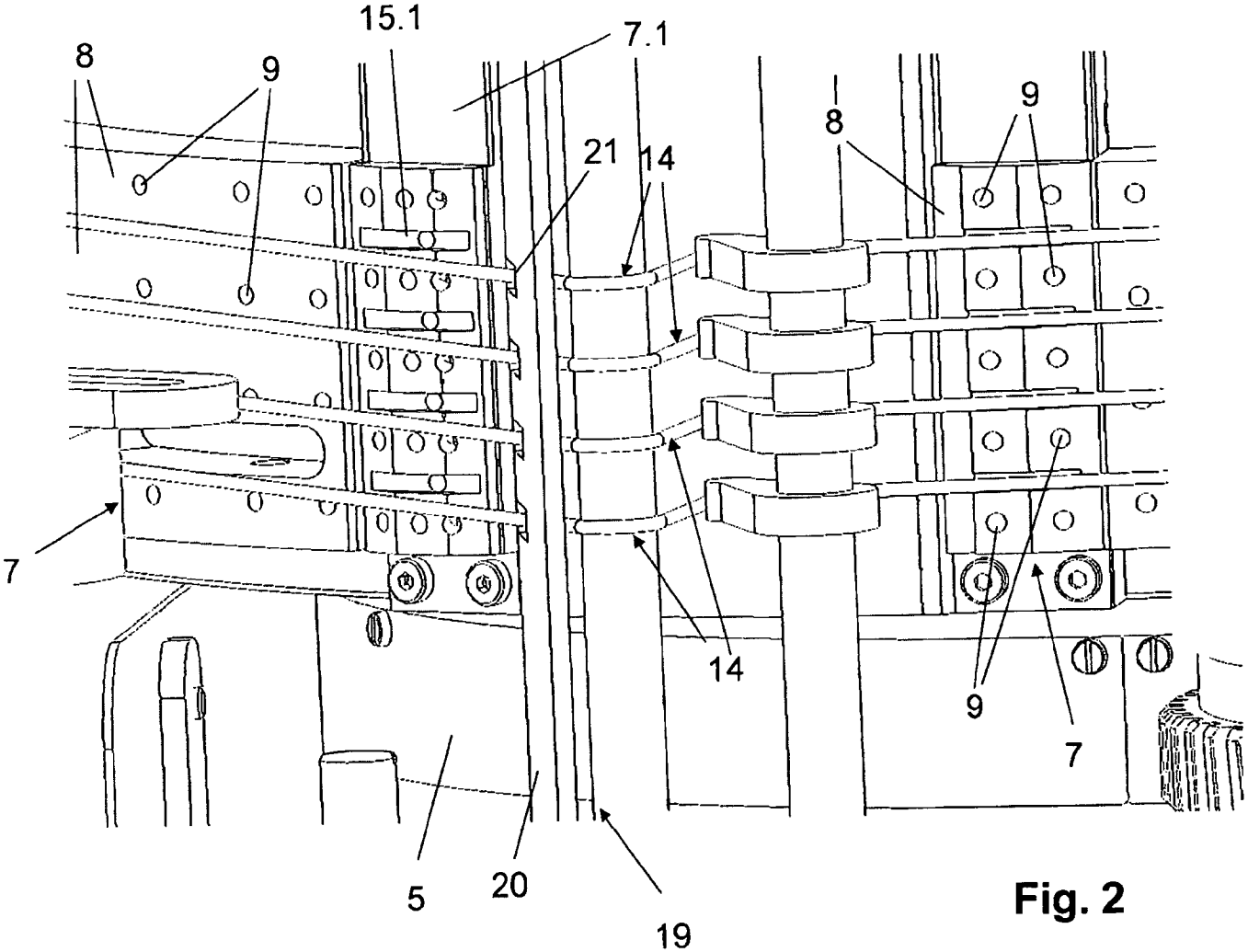
FIG. 2 shows a partial side view of the vacuum drum of FIG. 1 in a line of sight indicated in this figure by arrow A.
Figure 3:
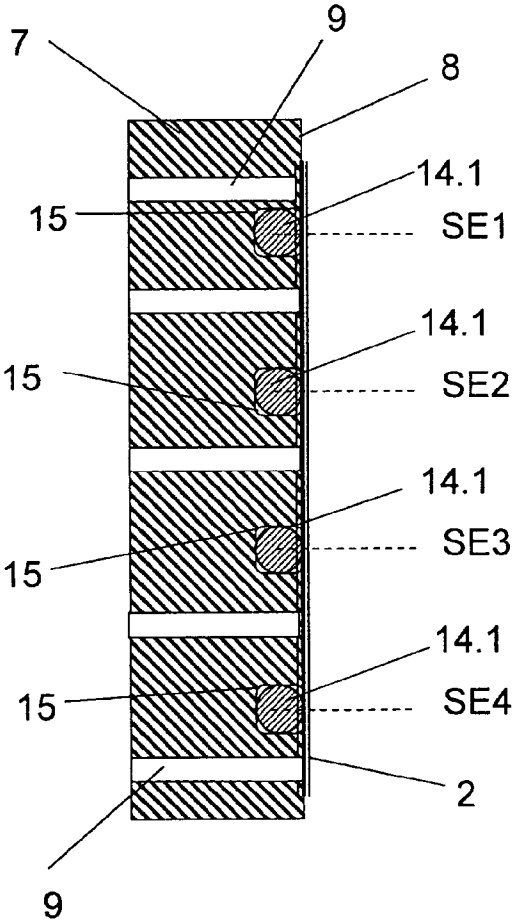
FIG. 3 shows a simplified partial section through the vacuum drum of the labeling unit shown in FIG. 1.

For this purpose, and as shown in FIGS. 2 and 3, the vacuum drum 5 is configured, at least at segments 7, with radially open grooves 15 that extend in the direction of rotation of the vacuum drum (arrow C). The cross-sectional dimensions of the grooves 15, which like the loop levels SE1-SE4 are offset relative to and spaced apart from one another in the direction of the axis of rotation of vacuum drum 5, are matched to the cross-section of the belt-shaped elements 14 in such a way that each belt-shaped element 14 is fully accommodated over its loop length 14.1 guided around vacuum drum 5 in the corresponding grooves 15 of segments 7. This ensures that labels 2 are in contact over their full surface with the outer surfaces 8. Grooves 15.1, which match grooves 15, are preferably also provided in peripheral surface regions of the vacuum drum 5 between the segments 7, for example on retaining strips 7.1 disposed in those regions for the segments 7.

Relative to the direction of circulation C of the belt-shaped elements 14, after the latter leave the vacuum drum 5 or after the second transfer position 11, i.e. over the loop length 14.2, the belt-shaped elements are guided over a plurality of deflections 16, 17 and 18 in such a way that each belt-shaped element 14 is radially spaced apart from vacuum drum 5 over the loop length 14.2 by which it does not lie against the vacuum drum 5.

The deflections 16, 17 and 18 are formed, for example, by rollers mounted so as to be free to rotate about axes parallel to the axis of rotation of vacuum drum 5. The deflections 17 and 18 are also preferably part of a tensioning device that provides the required tension and hence the required contact pressure of each loop length 14.1 against the vacuum drum 5 so that the belt-shaped elements 14 or their loops are driven to circulate in the direction of the arrow C without their own drive solely by frictional contact with the rotating vacuum drum 5.

Relative to the direction of circulation (arrow C) of belt-shaped elements 14, a stripping device 19 is provided upstream of the deflection 17 to remove labels 2 that have not been transferred to a container 3 and that are still sticking to belt-shaped element 14. In the depicted embodiment, the stripping device 19 essentially comprises a stripping plate 20 that is disposed with its surface sides in vertical planes, i.e. in planes parallel or essentially parallel with the axis of rotation of vacuum drum 5, and at an angle to the direction of circulation (arrow C) of the belt-shaped elements 14 in such a way that the remaining labels or label residues are lifted off or peeled off the belt-shaped elements 14. A stripping plate 20 is formed in the manner of a comb having a plurality of recesses 21 that are open to its edge and through each of which a belt-shaped element 14 is guided.

The labeling unit 4 thus operates in the following manner:

During normal trouble-free operation, each of the reverse-glued labels 2 is applied to a container 3 as it is conveyed past the second transfer position 11. If, as a result of a malfunction, a glued label 2, hereafter referred to as a "remainder label," is not transferred from the vacuum drum 5 to a container 3, then it is initially entrained with the rotating vacuum drum 5 beyond the second transfer position 11. The remainder label is then taken up and guided by the belt-shaped elements 14, which at the beginning of loop length 14.2 project up out of the peripheral surface of vacuum drum 5. The remainder label is also supported on its front face and so is lifted up off the vacuum drum 5 such that, after it passes the deflection 16, for example, it falls off the belt-shaped element 14 as a result of the change in direction of the course of loop length 14.2 that occurs there. A remainder label 2 that is entrained by a belt-shaped element 14 is removed from the belt-shaped element 14 no later than at the stripping device 19 however. Consequently no labels 2 that have not been transferred to a container 3 as a result of a malfunction will remain on the drum 5. In addition, no residues, whether from a label or from glue, remain behind on the vacuum drum 5.

There are different reasons why labels 2 fail to transfer to containers 3. For example, a label 2 may not be able to adhere to the container properly, perhaps because not enough glue was applied. Labels 2 may also not be transferred to container 3 as a result of gaps in the container stream. These gaps can arise, for example, from malfunctions in the labeling machine itself or in upstream machines or units in a container treatment line. As a result of such a gap, there is no container 3 present at the second transfer position 11 to receive a label 2.

A particular advantage is also that the belt-shaped elements 14 are moved in the same direction as and synchronously or essentially synchronously with the vacuum drum 5. As a result, removal of un-transferred labels 2 does not require any elements that are in contact with or rub against the periphery of vacuum drum 5. This avoids additional wear and malfunctions. As a result, the labeling unit 4, and in particular the vacuum drum 5 and its label removal device 13, are highly reliable.

Belt-shaped elements 14 can assist in the transfer and/or pressing of labels 2 against a waiting container 3, especially if these elements or loop length 14.2 follow an appropriate path at the transfer position 11. This is a particular advantage if the labeling machine is operating at a high throughput, i.e. with a high number of labeled containers being processed per unit of time. Under these circumstances, only an extremely short time is available for transferring labels 2 to respective container 3.

Figure 5:
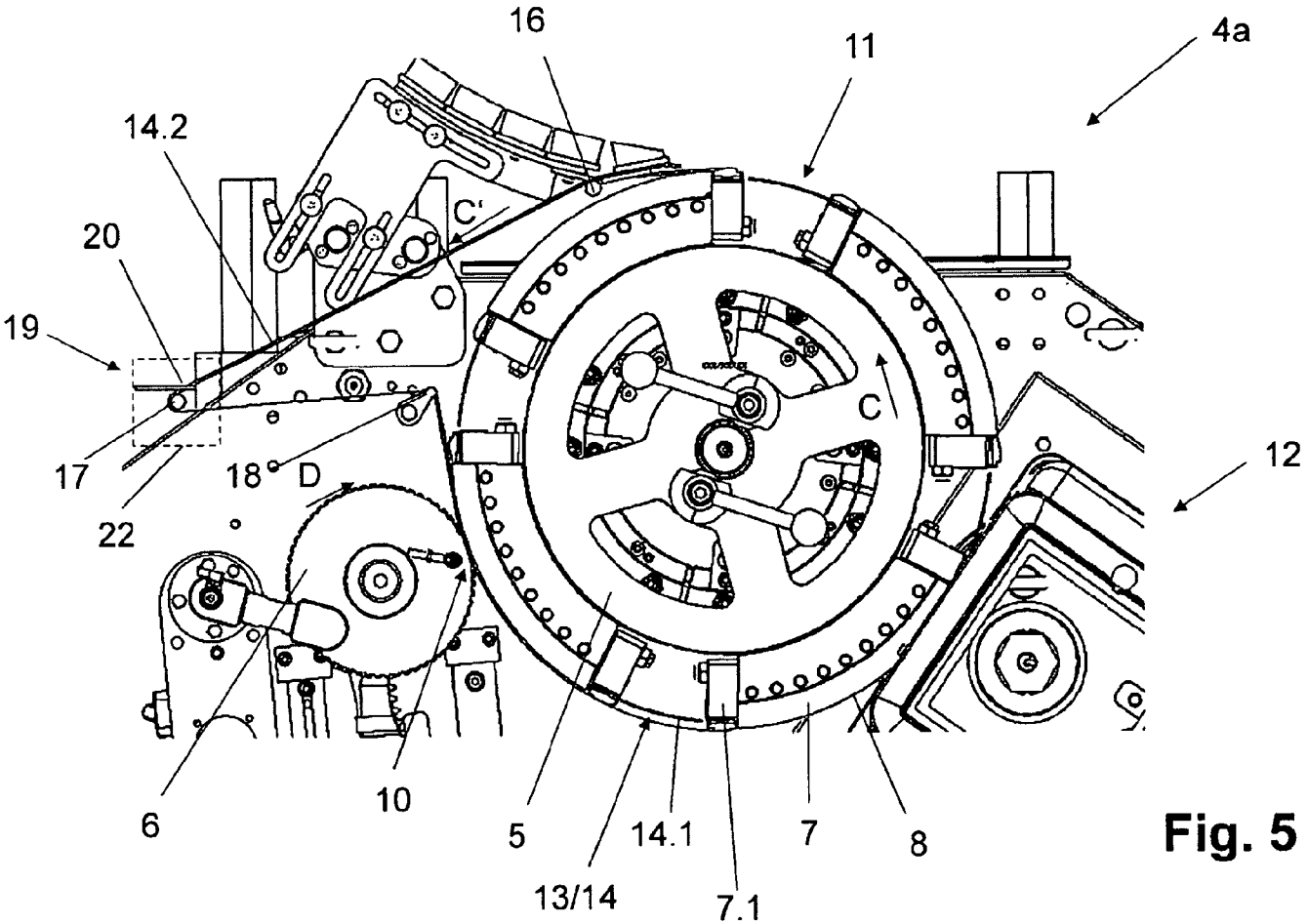
FIG. 5 shows, in a view as FIG. 1, a further embodiment of the inventive labeling unit.

In a representation similar to FIG. 1, FIG. 5 shows as a further embodiment a labeling unit **4*a* that only differs from the labeling unit 4 shown in FIGS. 1-3 by having a deflection 17 for the belt-shaped elements 14 have a greater radial distance than in labeling unit 4 from the axis of rotation of the vacuum drum 5 and that consequently this deflection and stripping device 19 which in the direction of circulation (arrow C) of belt-shaped elements 14 is disposed immediately upstream of the deflection 17 are located far outside the sensitive region of the labeling unit 4*a*/vacuum drum 5. Whereas with the labeling unit 4, the radial distance of the deflection 17 or stripping device 19 from the outer surface of the vacuum drum 5 is less than half the diameter of the drum, with the labeling unit 4*a* this radial distance is about equal to or greater than half the diameter of vacuum drum 5 or slightly less, being for example 30% to 200% of the diameter of vacuum drum 5**.

In FIG. 5, a label receptacle 22 (for example a collector) is provided under stripping device 19 for receiving or collecting detached labels 2 or label residues.

Belts or ropes made from plastic and/or from a metal material, wires, chains etc. are suitable, for example, for belt-shaped elements 14.

The invention has been described hereinbefore by reference to one embodiment. It goes without saying that numerous variations as well as modifications are possible without departing from the inventive concept underlying the invention.

It has been assumed above that belt-shaped elements 14 and/or the loops that they form circulate in the same direction as and synchronously or essentially synchronously with the vacuum drum and to this end are driven only by frictional contact with vacuum drum 5. Alternatively or additionally to this, provision can be made for belt-shaped elements 14 to be driven by at a variable speed by a dedicated drive.

It has been further assumed above that labels 2 are transferred to vacuum drum 5 by a transport drum 6. The present invention may of course also be extended to embodiments in which a transport drum 6 can be dispensed with. For example, by the labels being directly produced by being cut to length on the vacuum drum, or for example by labels 2, once they have been cut to length, not being transferred to vacuum drum 5 by a transport drum but by belt-shaped elements.

Having described the invention, and a preferred embodiment thereof, what is new and secured by Letters Patent is:

1. An apparatus comprising a labeling unit for applying labels to containers, said labeling unit comprising a label removing device, a vacuum drum, and a gluing device, wherein said vacuum drum is driven to rotate along a first rotation direction about a drum axis, wherein said vacuum drum receives labels at a first transfer position, wherein said vacuum drum delivers said labels to a second transfer position, wherein said gluing device is arranged within an angular region of rotary motion of said vacuum drum, wherein said angular region of rotary motion of said vacuum drum extends between said first transfer position and said second transfer position, wherein said vacuum drum is configured to move labels past said gluing device, wherein said gluing device is configured to glue labels that are moved past said gluing device by said vacuum drum, wherein said label removal device is configured for removing at least one of labels and label residues that remain on said vacuum drum in said angular region, and wherein said label removal device comprises a belt-shaped element forming a closed loop and surrounding said vacuum drum with a first loop length over an angular region of rotary motion of said vacuum drum at least between said first transfer position and said second transfer position and forming at least a second loop length that follows the second transfer position and on which the belt-shaped element is spaced at a distance from a periphery of the vacuum drum.

2. The apparatus of claim 1, wherein said label removal device comprises two belt-shaped elements, each of which forms a closed loop, said loops being offset relative to and spaced apart from one another in a direction along said drum axis.

3. The apparatus of claim 1, wherein said belt-shaped element is driven to rotate along said first rotation direction.

4. The apparatus of claim 1, wherein said belt-shaped element is driven to rotate by friction.

5. The apparatus of claim 1, wherein said belt-shaped element is driven to rotate by said vacuum drum.

6. The apparatus of claim 1, further comprising a separate drive, wherein said belt-shaped element is driven to rotate by said separate drive.

7. The apparatus of claim 1, where said labeling unit is configured for relative motion between said vacuum drum and said belt-shaped element.

8. The apparatus of claim 1, further comprising a tensioning device, wherein said belt-shaped element is guided at said second loop length thereof over said tensioning device.

9. The apparatus of claim 8, wherein said vacuum drum has a diameter, wherein said belt-shaped element is guided such that a maximum distance of said second loop length from at least one of said vacuum drum and a periphery of said vacuum drum is at least equal to 25% of said diameter.

10. The apparatus of claim 8, wherein said vacuum drum has a diameter, wherein said belt-shaped element is guided such that a maximum distance of said second loop length from at least one of said vacuum drum and a periphery of said vacuum drum is at least equal to between 30% and 200% of said diameter.

11. The apparatus of claim 1, further comprising a deflection, wherein said belt-shaped element is guided at said second loop length thereof over said deflection.

12. The apparatus of claim 11, wherein said vacuum drum has a diameter, wherein said belt-shaped element is guided such that a maximum distance of said second loop length from at least one of said vacuum drum and a periphery of said vacuum drum is at least equal to 25% of said diameter.

13. The apparatus of claim 11, wherein said vacuum drum has a diameter, wherein said belt-shaped element is guided such that a maximum distance of said second loop length from at least one of said vacuum drum and a periphery of said vacuum drum is at least equal to between 30% and 200% of said diameter.

14. The apparatus of claim 1, further comprising grooves in said vacuum drum, said grooves being disposed at least over a surface of said vacuum drum that forms a contact surface for labels, wherein said grooves run in a peripheral direction of said vacuum drum, wherein each groove is configured to receive a belt-shaped element in a region of said first loop length, wherein each groove has a cross-section that is matched to a cross-section of said belt-shaped element such that said belt-shaped element is fully received in a groove.

15. The apparatus of claim 14, further comprising vacuum openings, wherein said vacuum openings are offset from said grooves, wherein said vacuum openings enable said labels to be held with a vacuum that is provided on said surfaces that form contact surfaces for said labels.

16. The apparatus of claim 1, wherein said second transfer position is configured for a transfer of said labels to said containers.

17. The apparatus of claim 1, further comprising a transport element that can be driven to rotate, said transport element comprising a plurality of treatment positions, wherein said labeling unit is disposed in one of said treatment positions.

18. A method for operating a labeling unit for applying labels to containers, said labeling unit comprising a label removing device, a vacuum drum, and a gluing device, wherein said vacuum drum is driven to rotate along a first rotation direction about a drum axis, wherein said vacuum drum receives labels at a first transfer position, wherein said vacuum drum delivers said labels to a second transfer position, wherein said gluing device is arranged within an angular region of rotary motion of said vacuum drum, wherein said angular region of rotary motion of said vacuum drum extends between said first transfer position and said second transfer position, wherein said vacuum drum is configured to move labels past said gluing device, wherein said gluing device is configured to glue labels that are moved past said gluing device by said vacuum drum, wherein said label removal device is configured for removing at least one of labels and label residues that remain on said vacuum drum in said angular region, said method comprising at least one of receiving labels that have been left behind on said vacuum drum or removing labels that have been left behind on said vacuum drum, wherein receiving labels that have been left behind on said vacuum drum comprising receiving by at least one belt-shaped element that partially surrounds said vacuum drum with a first loop length that forms one part of a loop, and that is spaced apart from said vacuum drum with a second loop length that forms another part of said loop.

* * * * *